US005205490A

United States Patent [19]

Steinhardt et al.

[11] Patent Number: 5,205,490

[45] Date of Patent: Apr. 27, 1993

[54] BODY SPRAY NOZZLE

[75] Inventors: Michael D. Steinhardt, Kiel; Kathleen S. DeKeyser, Hingham; Kenneth J. Sieth, Cedarburg; David K. Rische, Sheboygan, all of Wis.

[73] Assignee: Kohler Co., Kohler, Wis.

[21] Appl. No.: 790,274

[22] Filed: Nov. 8, 1991

[51] Int. Cl.[5] ..... B05B 1/12

[52] U.S. Cl. ..... 239/449; 239/447; 239/587.4; 137/874

[58] Field of Search ..... 239/436, 443, 444, 446, 239/447, 448, 449, 587.3, 587.4, 537, 538; 137/874, 876, 625.46

[56] References Cited

U.S. PATENT DOCUMENTS

| | | | |
|---|---|---|---|
| 166,654 | 8/1975 | Thomson . | |
| 3,261,369 | 7/1966 | Thiele . | |
| 3,558,054 | 1/1971 | Ragot | 239/539 |
| 3,801,019 | 4/1974 | Trenary et al. | 239/383 |
| 4,221,338 | 9/1980 | Shames et al. | 239/449 |
| 4,330,089 | 5/1982 | Finkbeiner | 239/383 |
| 4,339,833 | 7/1982 | Mandell | 4/542 |
| 4,598,866 | 7/1986 | Cammack et al. | 239/447 |
| 4,674,687 | 6/1987 | Smith et al. | 239/449 |
| 4,754,928 | 7/1988 | Rogers et al. | 239/449 |
| 4,944,457 | 7/1990 | Brewer | 239/242 |
| 5,033,897 | 7/1991 | Chen | 239/447 |
| 5,073,996 | 12/1991 | Schinle | 4/601 |

FOREIGN PATENT DOCUMENTS

| | | | |
|---|---|---|---|
| 29798 | 5/1884 | Fed. Rep. of Germany | 239/436 |

*Primary Examiner*—Andres Kashnikow
*Assistant Examiner*—Christopher G. Trainor
*Attorney, Agent, or Firm*—Quarles & Brady

[57] ABSTRACT

A body spray nozzle is disclosed wherein the spray pattern can be easily adjusted and the nozzle can be oscillated in a support in a shower fixture. A movable valve element which is cup-shaped is positioned in a valve body and with the base thereof to the inlet side of a stationary valve element. Rotation of the movable valve element is effected from the front of the valve housing which directs different flow paths to a nozzle portion. Two or more of the body spray nozzles are interconnected with linkage members for oscillation by an oscillating source.

10 Claims, 6 Drawing Sheets

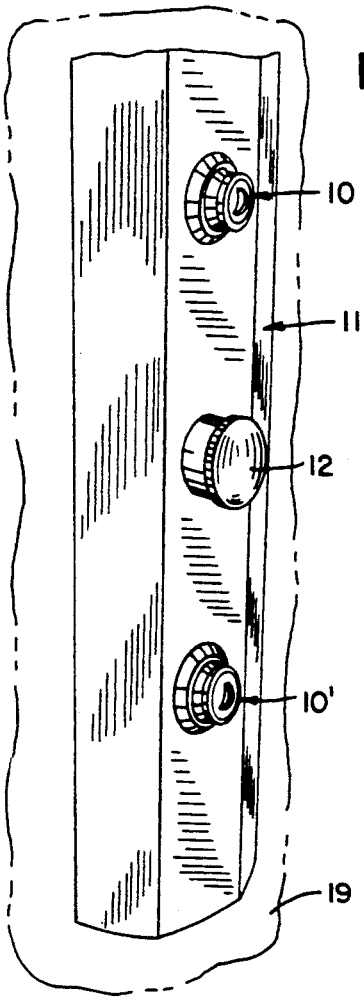
FIG. 1
FIG. 2
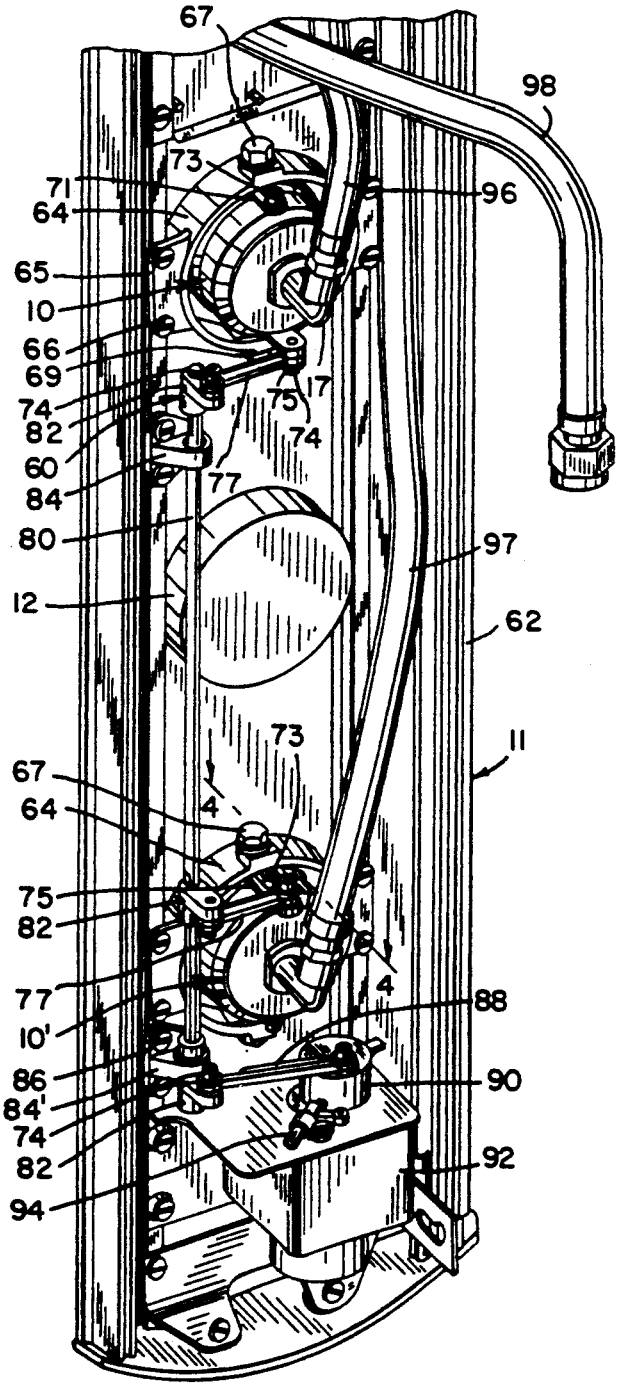
FIG. 4
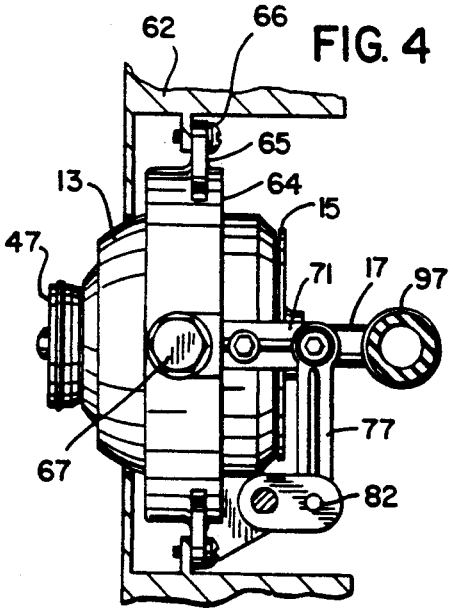

FIG. 5
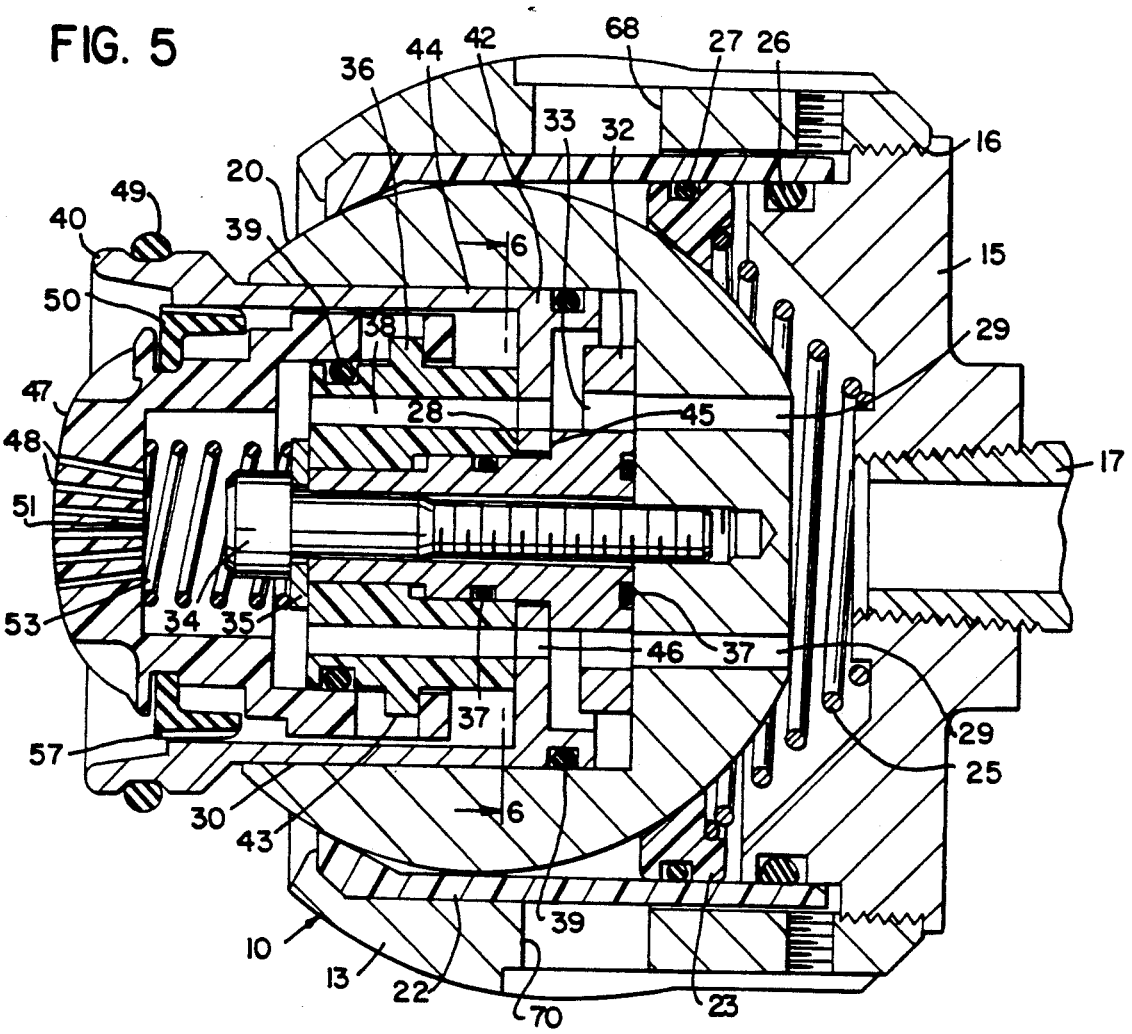
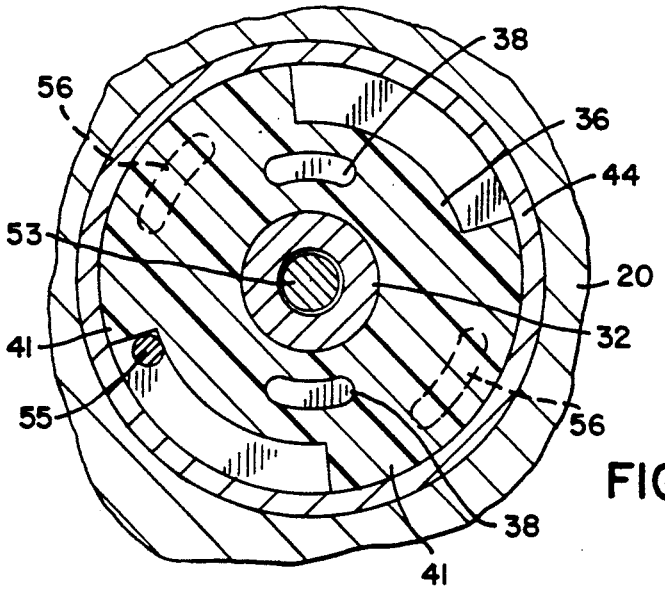
FIG. 6

FIG. 7
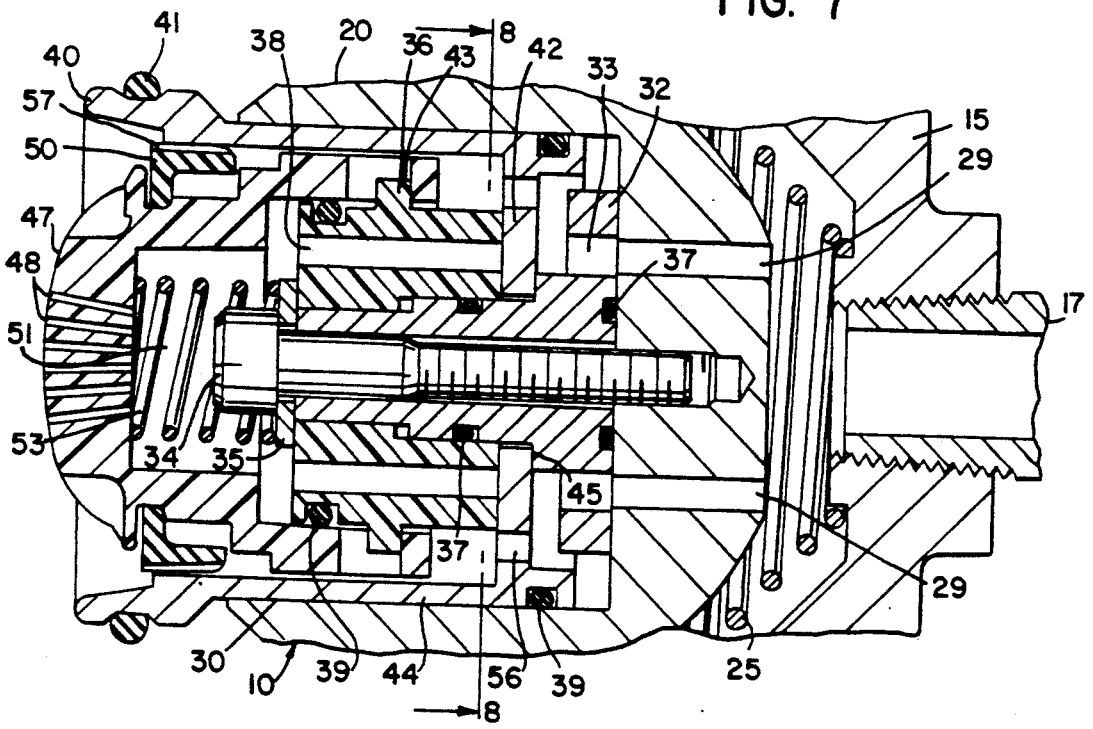
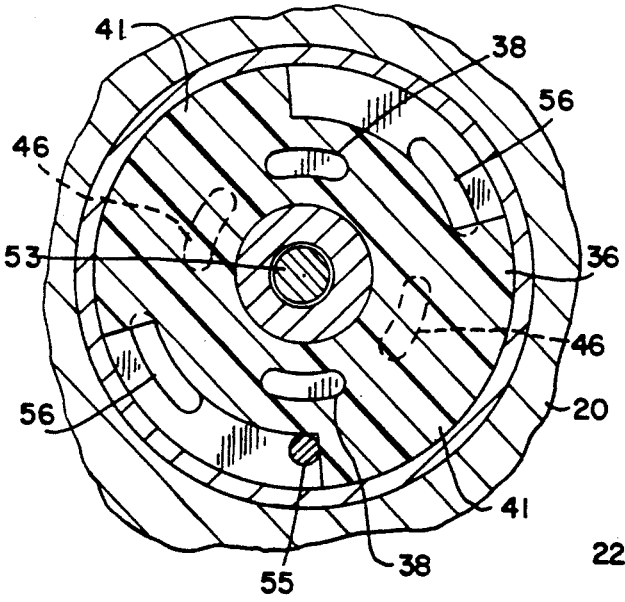
FIG. 8
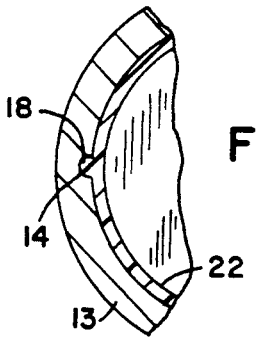
FIG. 9
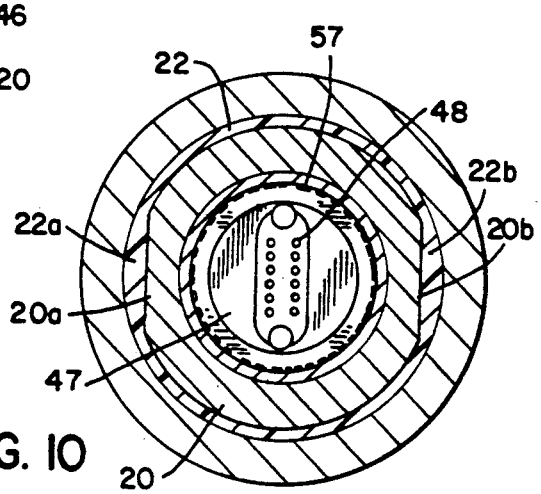
FIG. 10

BODY SPRAY NOZZLE

BACKGROUND OF THE INVENTION

A. Field Of The Invention

This invention relates primarily to body spray nozzles wherein the spray pattern can be easily adjusted. More particularly, the invention relates to nozzles of the foregoing type which can be oscillated in a shower fixture.

B. Description Of The Art

It is desirable to provide shower type nozzles with different spray patterns to accommodate the likes of the bather. It is known to provide nozzles with different spray patterns which are achieved by rotating a portion of the shower head. For example in U.S. Pat. No. 166,654 different flow paths are obtained in a nozzle head by rotating a cup-like member so as to orient different passages with parts in the nozzle. U.S. Pat. Nos. 3,558,054 and 3,801,019 also disclose different flow paths in a nozzle structure. In the '054 patent the spray head is rotated and in the '019 patent a shutter plate is used in conjunction with gears and pinions. A problem with these prior art nozzles is that they are not aesthetically appearing, can become disassembled during use or require a multiplicity of moving parts.

A need exists for an improved nozzle which can overcome the foregoing problems of the prior art.

There is also a need in the art of oscillating a nozzle of the foregoing type in a shower fixture so as to automatically cover a wide area of the body. It is also desirable that more than one nozzle be oscillated at the same time. It is desirable to do this with minimal parts and in a compact setting. For example, see U.S. Pat. No. 3,261,369.

SUMMARY OF THE INVENTION

In one aspect, the invention provides a valve for use in a housing, of a type wherein the flow path of fluid from outlets in the valve can be interchanged to produce two kinds of sprays. A valve body has an inlet portion and an outlet nozzle portion.

A stationary valve element is connected to the housing in the inlet portion with the stationary valve element having at least one fluid passage therethrough.

A movable valve element has a first wall portion extending over a portion of the stationary valve element at an inlet side thereof. The movable valve element has a first aperture for alignment with the fluid pathway in the stationary valve element to provide a first fluid pathway. The movable valve element has a second aperture to provide a second fluid pathway in conjunction with the stationary valve element, the movable valve element having a second wall extending from the first wall to the outside of the housing.

A nozzle member is receivable in the housing with the nozzle member having first and second spray portions.

The stationary and movable valve elements are constructed and arranged to provide communication of the first fluid pathway with the first nozzle spray portion when in one position and with the second fluid pathway and the second spray portion when the movable valve element is rotated to a second position.

In a preferred form the movable valve element is of a generally cup-shape with first wall portion forming the base thereof.

Also preferably the first and second apertures of the movable valve element are disposed on different diameters of the first wall portion.

In another aspect there is an oscillating shower apparatus which includes a support member and first and second nozzle members pivotally attached to the support member in a spaced manner with a pivotal axis of rotation in a vertical plane. First and second linkage members are connected to the first and second nozzle members at one point.

A third link member is connected to the first and second link members at another point. Oscillating means are provided and linkage means connects the oscillating means and the third link member.

In a preferred manner the nozzle members have a valve body with opposing flat surfaces to match with flat surfaces in a housing to prevent rotation of the valve body yet allow oscillation and vertical orientation.

The objects of the invention therefore include:

a. providing a body spray nozzle of the above kind which is durable in its construction and is not easily disassembled during use;
b. providing a body spray nozzle of the above kind which is aesthetically attractive;
c. providing a body spray nozzle of the above kind which is adaptable to be oscillated in a shower fixture;
d. providing an oscillating shower apparatus which includes the foregoing body spray nozzle;
e. providing an oscillating shower apparatus of the above kind which has linkage members and means connecting the body spray nozzles to an oscillating means.
f. providing an oscillating shower apparatus of the above kind which allows for oscillation and vertical orientation of a spray nozzle yet prevents undesirable rotation.

These and still other objects and advantages of the invention will be apparent from the description which follows. In the detailed description below, the preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

FIG. 1 is a perspective view showing the spray nozzles of this invention in a shower enclosure.

FIG. 2 is an enlarged perspective view showing the back of the enclosure shown in FIG. 1.

FIG. 4 is a view in section taken along line 4—4 of FIG. 2.

FIG. 5 is a view in vertical section showing one of the spray nozzles of this invention in one mode of operation.

FIG. 6 is a view taken along line 6—6 of FIG. 5.

FIG. 7 is a view similar to FIG. 5 showing the body spray nozzle in another mode of operation.

FIG. 8 is a view taken along line 8—8 of FIG. 7.

FIG. 9 is a partial and enlarged view showing the placement of a bearing member in the nozzle housing.

FIG. 10 is a view in vertical section illustrating the non-rotation prevention means of the nozzle in conjunction with a bearing member.

BRIEF DESCRIPTION OF THE PREFERRED EMBODIMENTS

Referring to FIGS. 1 and 2, the spray nozzles generally 10 are mounted in the panel housing 11 which also contains the usual mixing valve 12. The panel housing is mounted to a wall 19 forming a part of a shower fixture. As there indicated, two spray nozzles are depicted and are disposed for oscillation as will be described later in conjunction with FIG. 2.

Figure 3A:
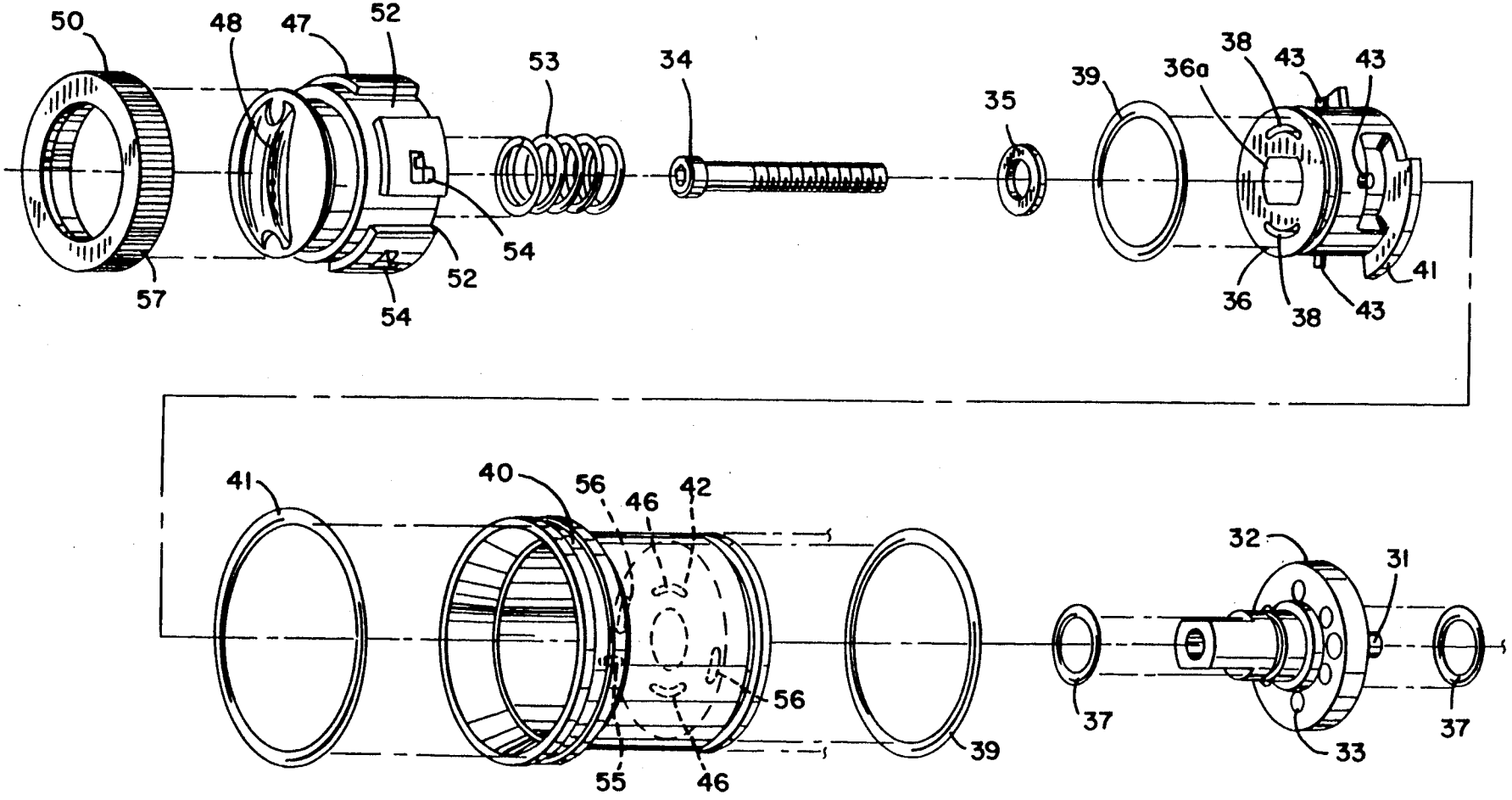
FIGS. 3*a* and 3*b* are assembly views of one of the spray nozzles of this invention.
Figure 3B:
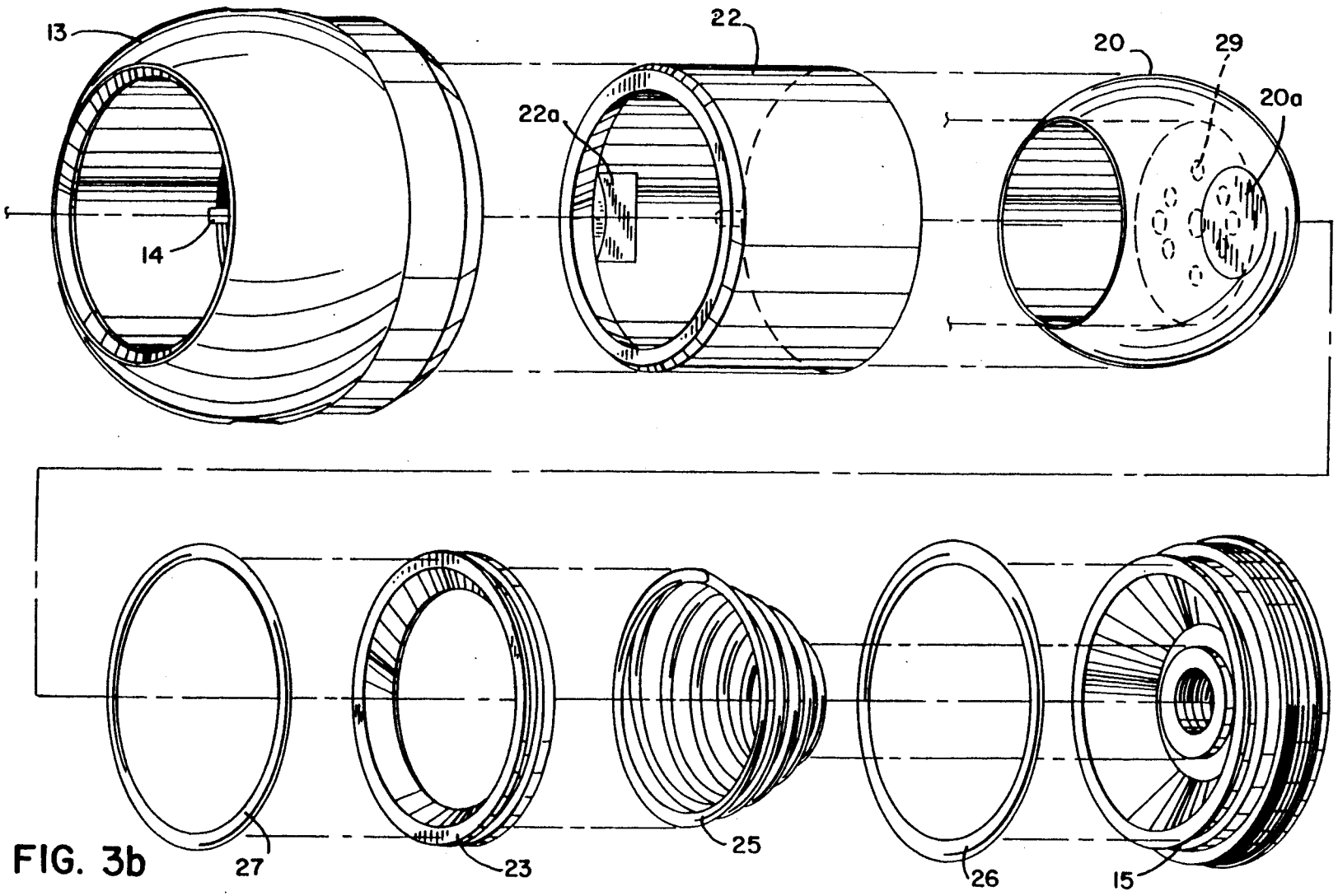

Referring first to the nozzles per se, these are shown in FIGS. 3*a*, 3*b*, as well as FIGS. 5 and 7. The spray nozzles include a housing 13 to which is threadably attached such as by threads 16, the back flange portion 15. A water inlet as indicated at 17 feeds water to the valve body 20 which is in the form of an eye. A bearing 22 is disposed between the housing 13 and the valve body 20. There is also a seal 23 which is biased against the valve body 20 by means of the conical spring 25. Appropriate O-type seals 26 and 27 are provided between the bearing 22 and the seal 23 as well as the bearing 22 and the flange 15.

Water passages 29 are provided in the valve body 20 to deliver water into the cavity 30 of the valve body 20. Disposed in the cavity 30 is a sleeve assembly 40 having a back wall 42 and a side wall 44. A hub member 32 extends through the back wall 42 of the sleeve assembly 40 and abuts against the wall 42 with the shoulder 45. Hub member 32 is secured to the valve body 20 by the screw 34 and the washer 35. The hub 32 has the water passages 33 for communication with the water passages 29 in the valve body 20. A stem member 36 is frictionally received over the hub 32 and retains the sleeve assembly 40 onto the hub 32 in a rotatable manner such as between the end wall 28 of the stem member 36 and the shoulder 45 of the hub member 32. There are suitable seals such as 37 placed between the hub member 32 and the valve body 20 as well as the stem 36. There are arcuate like water passages 46 and 56 in the back wall 42 of the sleeve assembly 40 (See FIG. 6), and there are two elongated water passages 38 in the hub 32 member.

A nozzle portion 47 is retained over the stem 36 such as by the projections 43 extending from the stem 36 and the bayonet type slots 54 in the annular body section 58 of nozzle portion 47. This is best seen in conjunction with FIG. 3*a*. An appropriate seal 39 is placed between the stem 36 and the nozzle portion 47. A spring 53 is housed in the nozzle cavity 51 for biasing the nozzle portion 47 onto the stem 36 in conjunction with the projections 43 and the bayonet slots 54. An outer spray ring 50 is secured to the nozzle portion 47 and has the outer nozzle spray passages 57, whereas the central portion has the inner spray passages 48. This is best seen in conjunction with FIG. 10.

A better understanding of the spray nozzles 10 will be had by a description of the flow of water through the various passages by means of the rotation of the sleeve assembly 40 to provide the different spray patterns. Looking at FIGS. 5 and 6 first, there the position of the sleeve assembly 40 is such that the water flow through the spray nozzles 10 and 10′ will be from the inlet 17 and out through the center spray passages 48 of the nozzle portion 47. This is effected by orienting the inner fluid passages 46 of the sleeve assembly 40 with the elongated passages 38 in the stem 36. The inner fluid passages 46 are seen in FIGS. 3*a* and 8. In this manner, water will flow from the water inlet 17 through the passages 29 of the valve body 20 and 33 of the hub 32, through the passages 46 in the wall 42 of the sleeve assembly 40, through the elongated slots 38 of the stem 36, into the cavity 51 of the nozzle portion 47 and out through the central spray passages 48. It should be noted in conjunction with FIG. 6 that in this instance water will not flow through the outer arcuate passages 56 in the sleeve assembly 40 as they will be blocked by the flange portions 41 of the stem 36.

When it is desired to have flow through the outer water spray passages 57, this is accomplished by rotating the sleeve assembly 40 to the position shown in FIGS. 7 and 8. Note in this instance that the rotation is stopped by a projection stop 55 which extends outwardly from the base wall 42 of the sleeve assembly 40 to engage a flange portion 41 of the stem. As illustrated in FIG. 8, outer arcuate passages 56 in back wall 42 are now in open communication past the flange portions 41 of the stem 36 whereas the apertures 46 which were previously aligned with water passages 38 are now disoriented, and consequently any flow is blocked to them. Water will, however, flow through the passages 56 around the outside of the stem 36, over the outside of the nozzle portion 47 through the grooves 52 with the water flow ultimately issuing from spray passages 57. It should be understood that the flow of water from inlet 17 to passages 56 is the same as previously described with respect to passages 46 in conjunction with FIG. 6.

Referring specifically to FIGS. 9 and 10, there is shown a means of preventing rotation of the valve body 20 inside the housing 13. This is accomplished by fixing the bearing 22 in the housing 13 by a notch 14 in the housing 13 and a projection or enlargement 18 extending from the bearing 22. Additionally, the valve body 20 has the flat portions 20*a* at opposite sides and the bearing has the flat portions 22*a* adjacent thereto. Thus as viewed in FIG. 10, this will allow an upward and downward pivoting of the valve body 20 but will prevent side to side rotation. This will be better understood in conjunction with the following description of the oscillation means wherein a side to side oscillation of the spray nozzles 10 and 10, is provided.

Figure 11:
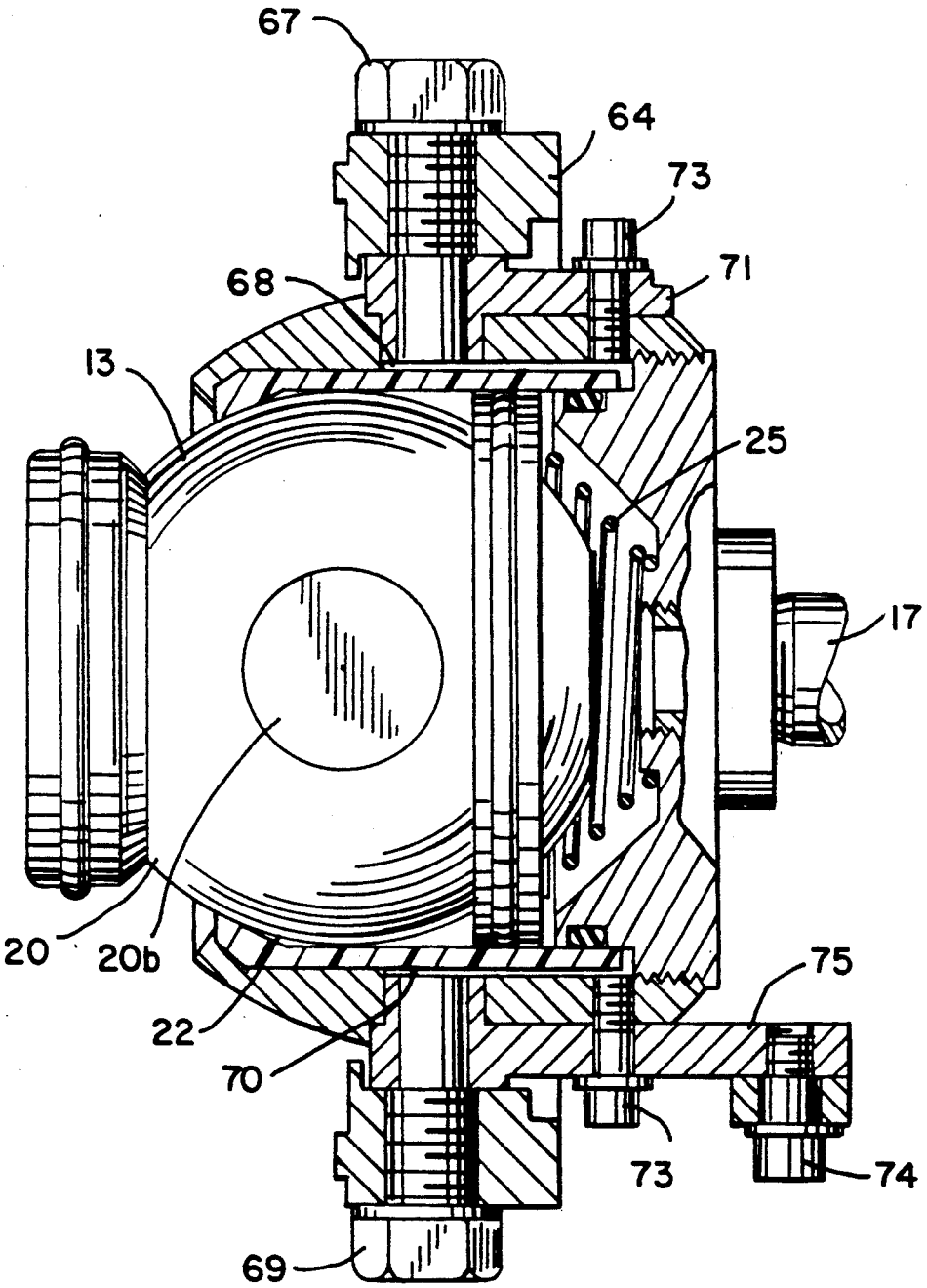
FIG. 11 is a view in partial vertical section illustrating the pivoting of the spray nozzle.

Referring to FIGS. 2 and 4, the two spray nozzles 10 and 10′ are pivotally mounted in the extrusion 62 of the panel housing 11 to comprise a shower apparatus generally 60. The spray nozzles 10 and 10′ are mounted in casing rings 64 which in turn are connected to the panel extrusion 62 by brackets 65 and screws 66. Opposing pivot pins 67 and 69 are threaded in the casing ring 64 and extend into the openings 68 and 70 of the valve body 13. Upper and lower pivotal bearing surfaces are provided by the brackets 71 and 75 which are mounted onto the valve housing 13 of each spray nozzle 10 and 10′ such as by the screws 73. This is best seen in FIG. 11. Brackets 75 are in turn connected to linkage members 77, such as by the shoulder screws 74, which in turn connect to rod member 80 by means of the connectors 82 and screws 74. Suitable guides 84 are provided for the rod 80, and a bearing 86 which is attached to rod 80 provides for rotatable support on the lower guide member 84′. Rod 80 is interconnected to an oscillating hub 90 of an oscillating motor 92 through the link 88. A switch 94 is placed in close proximity to the oscillating hub 90. The purpose of this switch is to provide a means through suitable electronics for always orienting spray nozzles in a central position when they are turned off. Water is delivered to the spray nozzles 10 and 10' through the inlet hoses 96 and 97 which will connect to the respective water inlets 17 of the spray nozzles 10 and 10'. It should be understood in this instance that the hose 98 will be connected to the mixing valve 12 and will feed the electronically controlled valves such as described in commonly assigned co-pending application Ser. No. 07/790,275 filed Nov. 8, 1991 entitled SHOWER ENCLOSURE ASSEMBLY. The teachings of this application are incorporated herein by reference. These valves in turn regulate flow to the inlet hoses 96 and 97.

It will therefore be appreciated that a spray nozzle is provided which is of a very durable construction in that a minimum number of parts is required in order to effect different spray patterns. Only the rotation of a sleeve assembly is required to effect this and without any internal gears. The sleeve assembly is readily accessible from the front of the nozzle and lends an aesthetic appearance thereto such as with the trim ring 49 in a compact design. The spray nozzles are readily adaptable for use in conjunction with an oscillation means wherein the nozzles can be moved from side to side. Further, there is provided herein a linkage and connection means for oscillating the nozzles which lends itself to a compact design in that it can be placed on a single panel extrusion. In the instance where maintenance is required for any reason, the spray nozzles are easily disassembled by removal of a nozzle portion which provides ready access through the nozzle portion for any cleaning as well to ready access to the inside of the spray nozzles if further disassembly is required. Thus, the invention provides an improved spray nozzle.

While the preferred embodiments have been described above, it should be readily apparent to those skilled in the art that a number of modifications and changes may be made without departing from the spirit and scope of the invention. For example, while the spray nozzles have been shown in conjunction with an oscillation means, they are suitable for use as only a single spray nozzle. Further, while two spray nozzles have been shown for oscillation, it is readily apparent that any number of nozzles could be interconnected by the linkage means as described herein.

Also, while a specific number of passageways have been described for use in conjunction with the component parts, the number of passageways can also be varied if desired. All such and other modifications within the spirit of the invention are meant to be in the scope of the invention.

I claim:

1. A body spray nozzle for use in a housing and of a type wherein the flow path of fluid from outlets in a valve can be interchanged to produce two kinds of sprays, comprising:

a valve body receivable in said housing having an inlet portion and an outlet portion;

a stationary valve element connected to said valve body in said inlet portion, said stationary valve element having at least one fluid passage therethrough;

a movable valve element having a first wall portion extending over a portion of the stationary valve element at an inlet side thereof, said movable valve element having a first aperture for alignment with said fluid pathway in said stationary valve element to provide a first fluid pathway, said movable valve element having a second aperture to provide a second fluid pathway in conjunction with said stationary valve element, said movable valve element having a second wall extending from said first wall to the outside of said valve body; and a nozzle member receivable in said valve body, said nozzle member having first and second spray portions;

wherein the stationary valve element and the movable valve element are constructed and arranged to provide communication of said first fluid pathway with said first nozzle spray portion when in one position and with said second fluid pathway and said second spray portion when said movable valve element is rotated to a second position.

2. The body spray nozzle of claim 1 wherein the movable valve element is of a generally cup-shape with said first wall portion forming the base thereof.

3. The body spray nozzle of claim 1 wherein the first and second apertures of the movable valve element are disposed on different diameters of the first wall portion.

4. The body spray nozzle of claim 1 wherein the stationary valve element is secured to the valve body by a hub member.

5. The body spray nozzle of claim 1 wherein the stationary valve element is formed with two opposing sections with said at least one fluid passage comprising a fluid passage in each section.

6. The body spray nozzle of claim 4 wherein the hub member has a plurality of apertures for orientation with apertures in the valve body.

7. The body spray nozzle of claim 1 wherein the nozzle member is retained in the valve body by an annular body portion having slots for engagement by projections on the stationary valve member.

8. The body spray nozzle of claim 1 wherein the movable valve element has a stop surface for engagement by a stop member on the first wall portion of the stationary valve element.

9. The body spray nozzle of claim 1 wherein the valve body is pivotally retained in the housing.

10. The body spray nozzle of claim 1 wherein the second spray portion is circumferentially positioned with respect to the first spray portion.

* * * * *

UNITED STATES PATENT AND TRADEMARK OFFICE

CERTIFICATE OF CORRECTION

PATENT NO. : 5,205,490

DATED : April 27, 1993

INVENTOR(S) : Michael D. Steinhardt, Kathleen S. DeKeyser, and David K. Rische

It is certified that error appears in the above-identified patent and that said Letters Patent is hereby corrected as shown below:

| | |
|---|---|
| Title page, item [75] Inventors: | Lines 2 and 3, "Kenneth J. Sieth, Cedarburg" should be deleted. |
| Title page, item [56] References cited | U.S. Patent Documents - Line 1 - after "166,654" "8/1975" should be --8/1875--. |
| Column 4, line 46 | after "nozzles" 10 and 10," should be --10 and 10'--. |

Signed and Sealed this

First Day of February, 1994

Bruce Lehman

*Attest:*

BRUCE LEHMAN

*Attesting Officer*

*Commissioner of Patents and Trademarks*